US005944189A

United States Patent [19]

Vollenweider et al.

[11] Patent Number: 5,944,189

[45] Date of Patent: Aug. 31, 1999

[54] SAMPLE BAGS HAVING THICKENED REGIONS

[75] Inventors: Juerg Vollenweider, Fehraltdorf; Erich Jaeger, Frauenfeld; Werner Heuberger, Baeretswil, all of Switzerland

[73] Assignee: Ferag AG, Hinwil, Switzerland

[21] Appl. No.: 09/001,646

[22] Filed: Dec. 31, 1997

Related U.S. Application Data

[62] Division of application No. 08/638,996, Apr. 24, 1996, Pat. No. 5,735,107.

[51] Int. Cl.[6] ..... B65D 33/02; B65D 73/00

[52] U.S. Cl. ..... 206/484; 383/107; 383/119; 383/108; 206/581; 206/524.2

[58] Field of Search ..... 383/32, 107, 108, 383/119, 120, 104, 126; 206/484, 484.2, 581, 524.2, 534.1

[56] References Cited

U.S. PATENT DOCUMENTS

| | | | |
|---|---|---|---|
| 2,440,022 | 4/1948 | Salfisberg | 206/484 |
| 2,442,936 | 6/1948 | Rohdin | 383/108 |
| 2,444,685 | 7/1948 | Waters | 383/108 |
| 2,673,495 | 3/1954 | Hecker | 383/107 |
| 2,737,339 | 3/1956 | Doyle | 383/107 |
| 2,961,063 | 11/1960 | Fesco | 383/120 |
| 3,195,801 | 7/1965 | Symons et al. | 383/126 |
| 3,471,990 | 10/1969 | Bonuchi et al. | 426/410 |
| 3,891,138 | 6/1975 | Glas | 206/484 |
| 3,939,972 | 2/1976 | Mayworm | 383/107 |
| 4,324,088 | 4/1982 | Yamashita et al. | 53/527 |
| 4,470,153 | 9/1984 | Kenan | 206/484.1 |
| 4,510,621 | 4/1985 | Sak et al. | 206/484 |
| 4,764,030 | 8/1988 | Humphrey | 383/120 |
| 4,787,506 | 11/1988 | Akao | 206/484 |
| 5,031,386 | 7/1991 | Schneider | 53/551 |
| 5,155,980 | 10/1992 | Mansson et al. | 53/551 |
| 5,241,804 | 9/1993 | Tsuruta et al. | 53/504 |
| 5,676,467 | 10/1997 | Gebhardt | 383/120 |
| 5,791,465 | 8/1998 | Niki et al. | 383/104 |

FOREIGN PATENT DOCUMENTS

| | | |
|---|---|---|
| 1 123 612 | 2/1962 | Germany . |
| 1 271 012 | 6/1968 | Germany . |
| 24 49 570 | 4/1976 | Germany . |
| 2 124 580 | 2/1984 | United Kingdom . |
| WO 86/03163 | 6/1986 | WIPO . |
| WO 86/05163 | 9/1986 | WIPO . |

*Primary Examiner*—Paul T. Sewell
*Assistant Examiner*—J. Mohandesi
*Attorney, Agent, or Firm*—Walter C. Farley

[57] ABSTRACT

Sample bags are produced from webs of film material by forming longitudinal seams and longitudinally spaced transverse seams and by filling the bags with a sample product between forming the transverse seams. In order to make the bags easier to handle, the longitudinal seams are thickened so that the thickness of the seams is equal to the thickness of the center of the bag. Thickening is done by rolling or folding the seams or by adding frames or strips of additional material either between or outside the seam or interior portions of the webs. The resulting bags are more easily stacked, handled and inserted into publications for distribution.

12 Claims, 8 Drawing Sheets

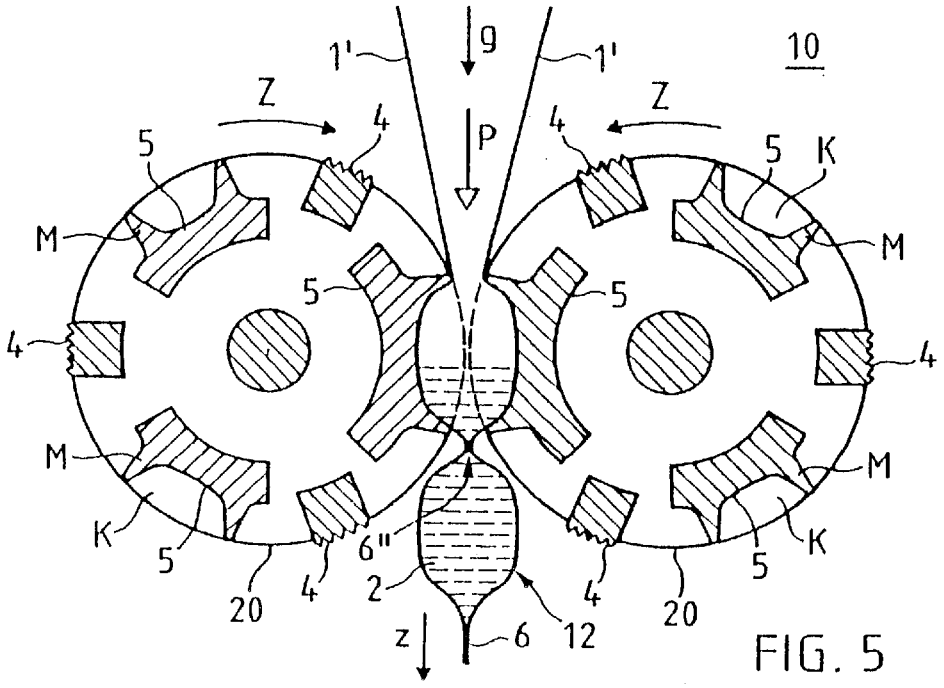
FIG. 5
FIG. 12a
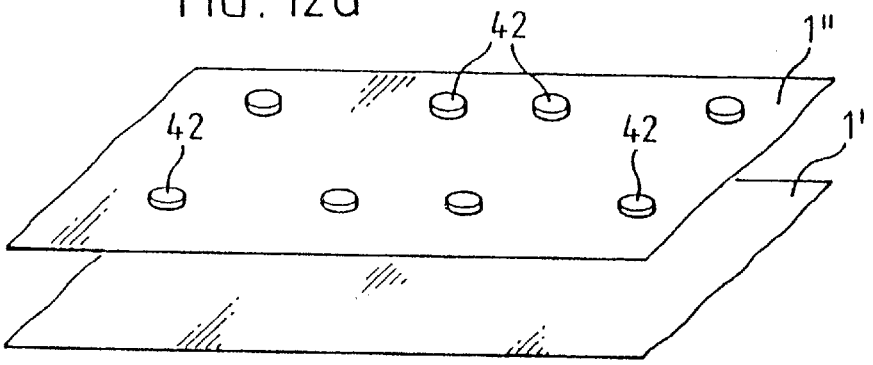
FIG. 12b
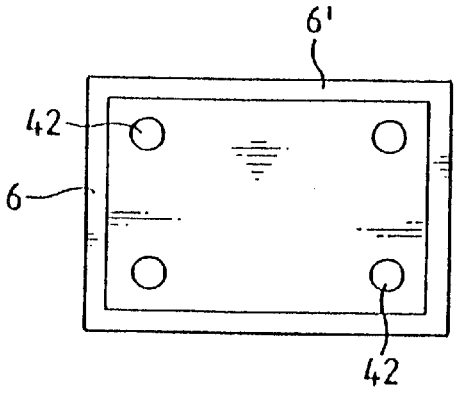

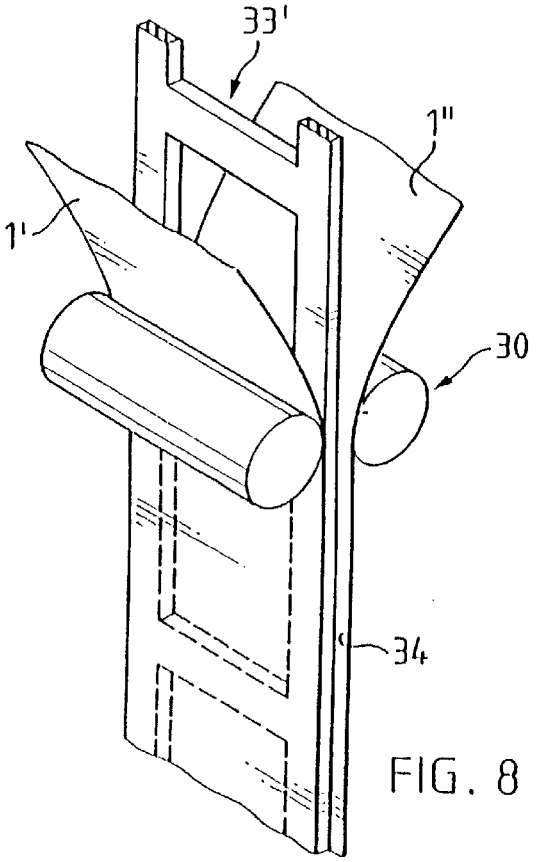
FIG. 8
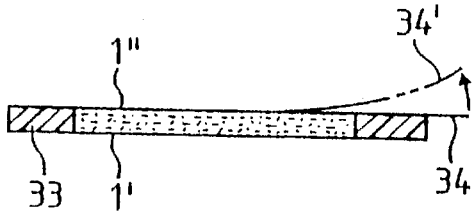
FIG. 8a
FIG. 9a
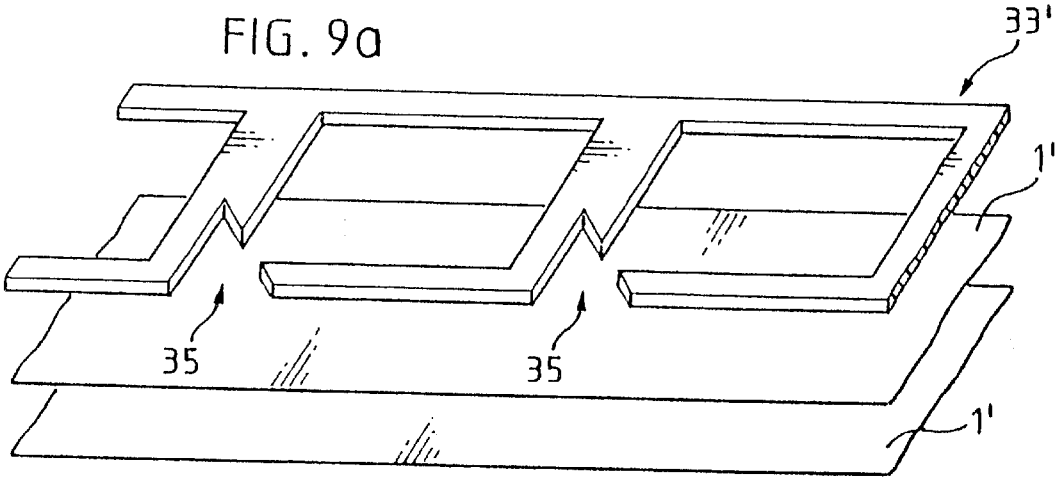
FIG. 9b
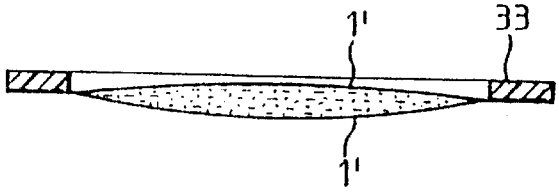

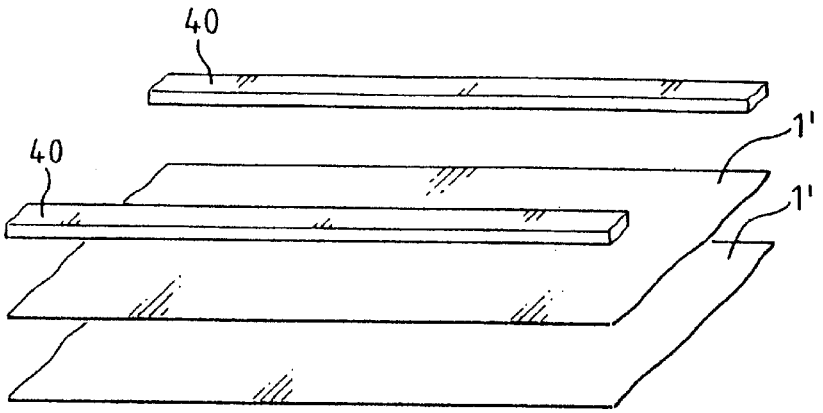
FIG. 10a
FIG. 10b
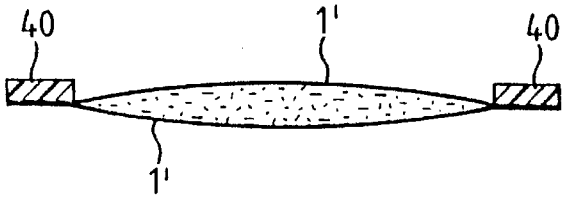
FIG. 11a
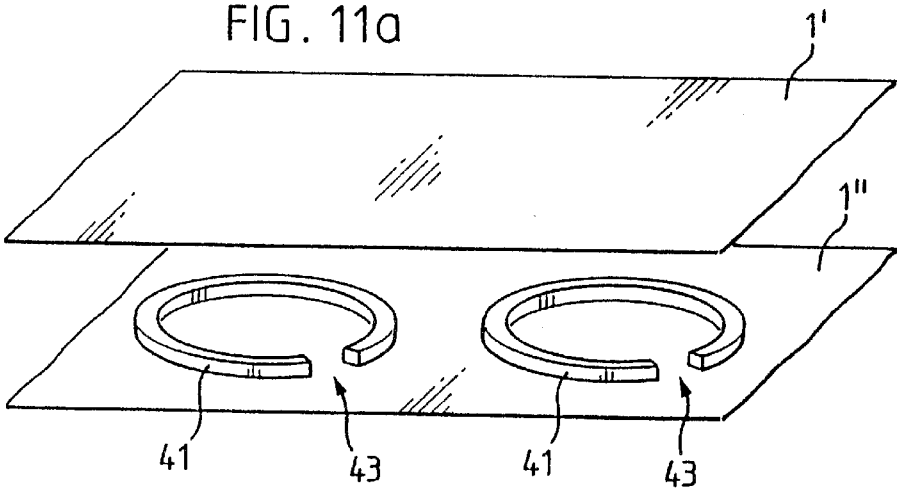
FIG. 11b
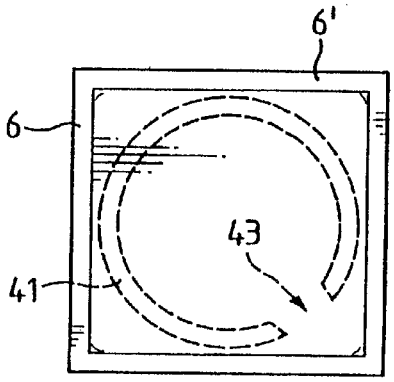

SAMPLE BAGS HAVING THICKENED REGIONS

CROSS-REFERENCE TO RELATED APPLICATION

This is a division of U.S. patent application Ser. No. 08/638,996 filed Apr. 24, 1996, now U.S. Pat. No. 5,735,107 issued Apr. 7, 1998.

FIELD OF THE INVENTION

This invention is in the field of the packaging industry and relates to a method which serves for producing sample bags. The invention also relates to a device for carrying out the method and to sample bags produced according to the method. The produced sample bags contain fluid or solid samples and are especially suitable for automated further process with high processing speed, e.g., for attaching them to or inserting them into printed products.

BACKGROUND OF THE INVENTION

The inserting, collecting, collating, etc., of additional printed items into printed products, especially into periodicals (e.g., newspapers, magazines, brochures, prospectuses, also books, etc.) has been expanded to other supplements to be combined with a printed product. Supplements in the form of sample bags which contain solid items, e.g., cleansing towels or fluid sample, e.g., cream, paste, liquids, etc., are very popular. The bags normally consist of two blanks of a packaging material mostly of a multilayer plastic or paper film, which blanks are connected with each other all along their edges.

Techniques for handling printed products, e.g., cards, as supplements are known and fairly well developed. The mechanical means are available and high speeds, adapted to the complete process, can be achieved. The handling of sample bags, in the largest sense of the word, however causes a new range of problems. Sample bags generally do not have a defined form. They can have the form of cushions thus not being flat as desired and often not even being outwardly cambered in the same places. If the contents are fluid, the form of the bag changes each time it is handled. Furthermore, the handling is even more difficult because the sample bags are usually made of a plastic with a smooth, sliding surface such that friction which is normally helpful for stacking is very small. Stacks or bundles of sample bags are not stable and thus difficult to process, especially with high processing speeds.

SUMMARY OF THE INVENTION

Such problems are solved by the invention. The greatest drawback for handling the sample bags in a process where they are inserted into printed products is found to be their form which is very unsuitable for forming stacks or bundles and which is in many cases not stable, i.e., the bag changes its form when handled. It is therefore the object of the invention to give the sample bags a stabilized form which is as flat as possible and which allows desirable handling of the sample bags by using, for producing the bags, a method which is modified compared with the state of the art. By stabilizing the bag, changes of form by shifting of the contents when the bag is being manipulated is prevented as far as possible. Furthermore, a cushion form of the bag is to be omitted or its influence on the forming of stacks or bundles to be restricted by further shaping means.

While the bag is being produced, the filled sample bags are conditioned for following processing in that, for stabilizing the form of the bags, additional shaping steps are introduced into the production method and/or additional forming elements are supplied into the production method.

The additional steps for stabilizing the form are integrated into the production method such that they only fractionally add to the expense of the method. Normally, the stabilizing of form of the sample bags does not result in a loss of speed. Regarding tools, additional expenses are possible, but these are insignificant compared with the advantages achieved.

The sample bags produced according to the invention can be handled individually or as a web much more easily than known sample bags because they have a stabilized form, i.e., a form which does not change substantially when handled and which is as flat as possible. For this reason, they can be stacked in stacks or bundles, they can be gripped individually and they can be further processed without problems, particularly at high processing speeds. Inside the printed product, the sample bag thus flattened does not add unnecessarily to the thickness of the printed product which means that more of such perfected sample bags can be integrated than before.

BRIEF DESCRIPTION OF THE DRAWINGS

Embodiments of the method and sample bags produced thereby are described with reference to the following drawings wherein:

FIG. 5 is a further embodiment of an apparatus for making sample bags;

FIG. 8 is a schematic perspective view of another apparatus and method for making sample bags;

FIG. 8*a* is an end elevation, in section, of a sample bag made by the method and apparatus of FIG.8; and FIGS. 9*a*, 9*b*–12*a*, 12*b* are views of various starting materials for making sample bags and bags made from those materials.

DESCRIPTION OF PREFERRED EMBODIMENTS

Figure 1:
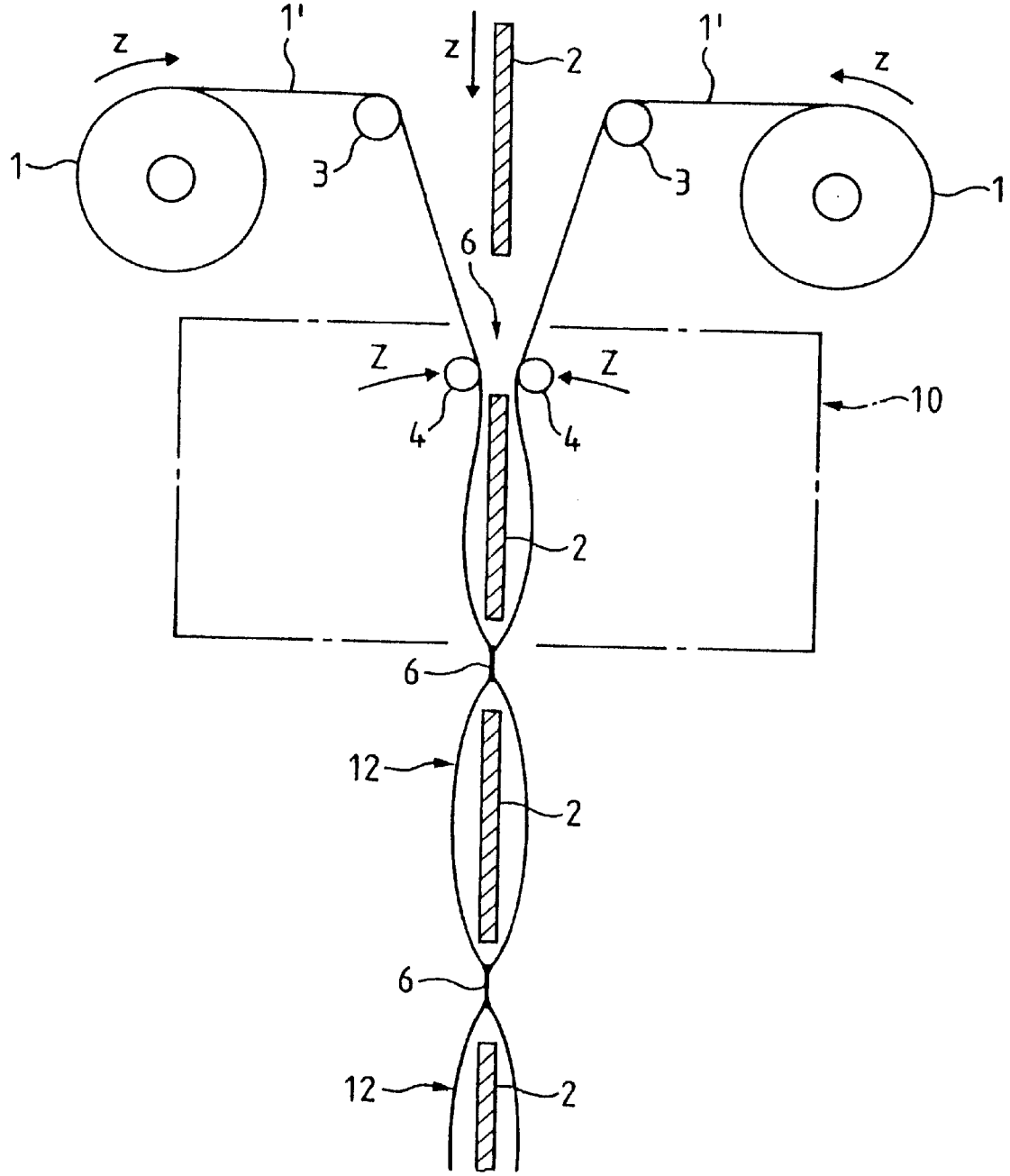
FIG. 1 PRIOR ART
FIG. 1 is a schematic side elevation of a prior art method for producing sample bags.

FIG. 1 shows in a very schematic manner an installation according to the state of the art for packaging sample products into bags. The principle of the packaging process is known: from rolls 1 webs of foil 1' with, e.g., a meltable coating are drawn in the direction of arrow z (z indicates the processing direction of the product) over deflection rollers 3 into a packaging part 10 of the installation where a sample product 2 is enveloped by the foil material. In part 10 of the installation, the webs of film are closed into bags by forming continuous longitudinal seams and equidistant transverse seams 6, whereby the bags being produced are filled with, e.g., a solid item 2 between the forming of successive transverse seams 6. As the sealing step is known, it is merely shown in a schematic manner, i.e., only the sealing elements, e.g., heating elements, for forming the transverse seams 6 of bags 12 are shown and their closing direction Z (Z indicates movement of parts of the device). The sealing elements for sealing the longitudinal seams are not shown.

The sample bags 12 which exit part 10 of the installation in the form of a quasi-endless web of bags are then normally separated from each other in the area of the transverse seams 6. The finished sample bags typically have the form of cushions.

Figure 2:
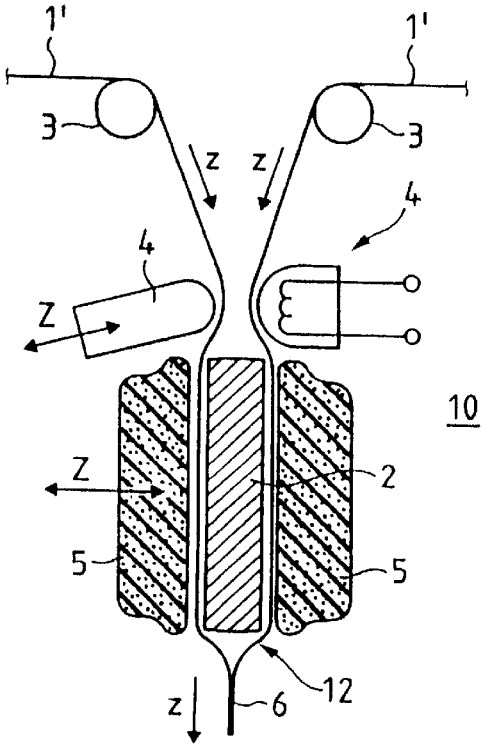
FIG. 2 is a schematic side elevation of one embodiment of a device for making bags in accordance with the invention.
Figure 2A:
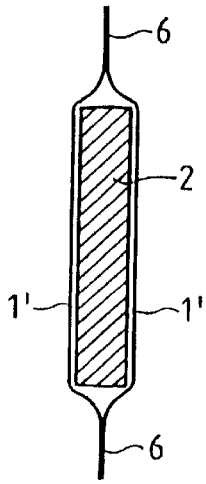
FIG. 2*a* is a schematic side elevation of a bag produced in the device of FIG. 2.

FIGS. 2 and 2*a* illustrate a first embodiment of the method according to the invention and the corresponding product. According to this embodiment, as an additional shaping measure, as much air as possible is pressed out of the bag before it is sealed and transverse seam 6 is formed after filling. Experiments with bags each containing a moist tissue as an example of a solid sample product have shown that, by pressing air out of the bag, astonishingly good results concerning the given objects are achieved.

FIG. 2 shows an installation for carrying out the method in a manner similar to FIG. 1 but with pressing of air out of the bags. The pressing is done stepwise with soft pressing elements 5, e.g., polyurethane cushions, substantially movable to-and-fro in direction Z which brings the bag into the desired form by pressing out superfluous gas. Pressing elements 5 are, e.g., as shown, a moveable cushion and a corresponding counter surface or two cushions moveable toward each other. Pressing elements 5 are arranged in the same part of the installation as the welding head 4 for sealing the transverse seams.

The pressed and welded sample bags, as shown in FIG. 2*a*, are rigid in a certain sense, keeping their form and, on handling, behave much more like a flat sample product than sample bags produced in a known manner (FIG. 1) which are soft and have the form of a cushion. The solidity achieved with the method according to FIGS. 2 and 2*a* is exactly the thing that was aimed for, making possible handling possibilities in a subsequent processing step which are conditions to high processing speeds.

Figure 3:
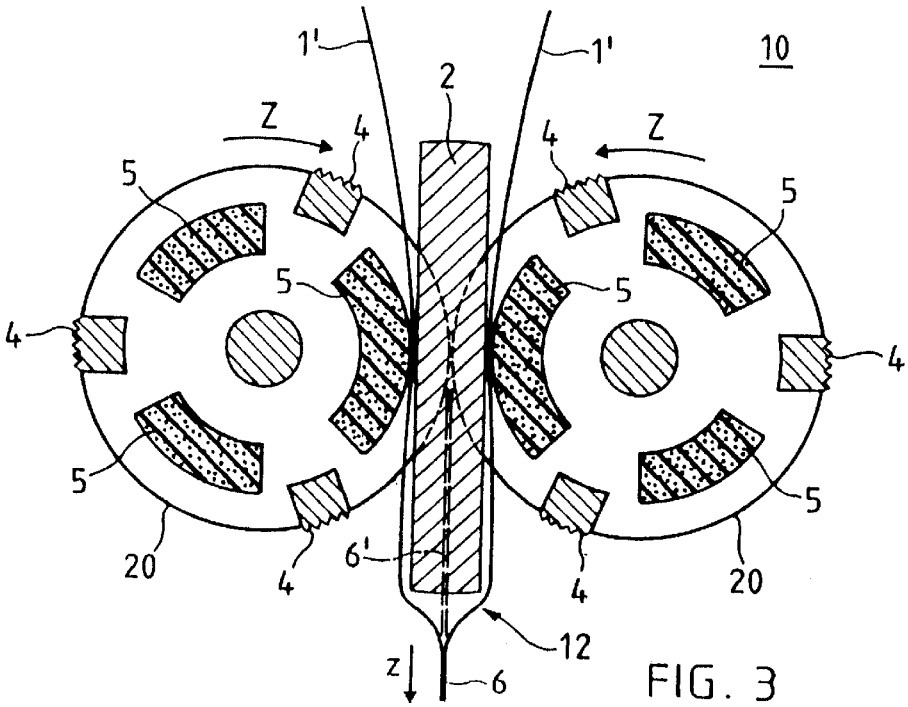
FIG. 3 is a schematic side elevation of a further embodiment of an apparatus for producing sample bags.

FIG. 3 shows in the same way as FIG. 2 an installation part 10 for continuously stabilizing the forms of bags with solid contents by pressing out air. The sealing elements 20 for the longitudinal seam and the sealing elements 4 for the transverse seam, as well as the pressing elements 5 for stabilizing the forms of the bags, are integrated into two cylinders or forming molds, respectively, between which the chamber for accepting the product sample is formed by means of longitudinal seams 6' between which the pressing out of the superfluous gas is carried out and between which the transverse sealing seam 6 is finally formed. Pressing elements 5 consist of a soft, flexible material which does not damage the sample product 2 in the sample bag when pressing. With opposed senses of rotation of the cylinders, according to arrows Z, the partially enveloped sample product is conveyed in direction z, is simultaneously enclosed by the longitudinal seams, conditioned (form-stabilized) and then sealed by means of a transverse seam. The transverse fins 4 (sealing elements) running in the axial direction of the cylinders serve for this purpose. It is not defined here whether the sealing is achieved by the forming of ribs or by welding or in a different manner.

Figure 4:
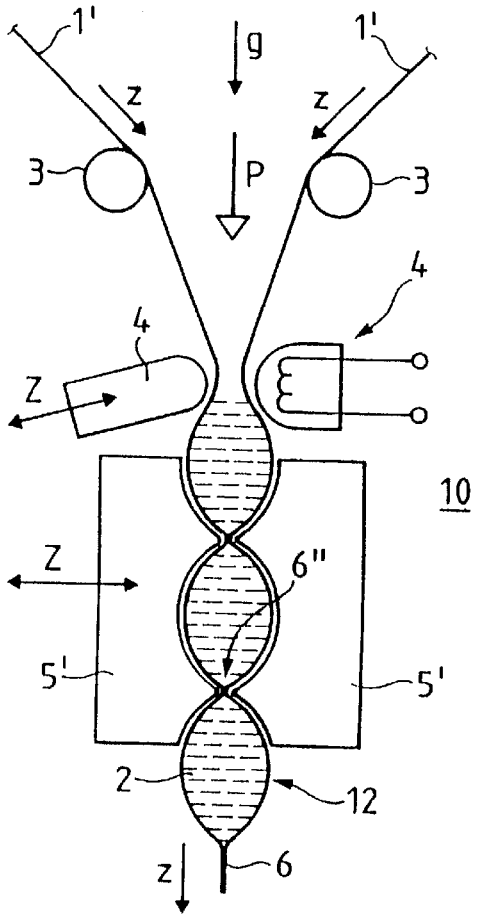
FIG. 4 is a schematic side elevation of a further embodiment of an apparatus for producing sample bags.
Figure 4B:
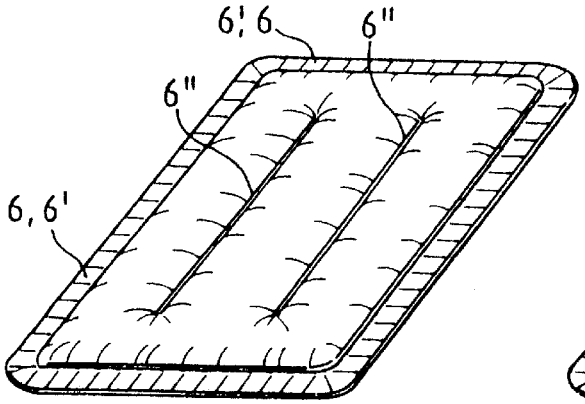
FIGS. 4*a* and 4*b* are schematic perspective views of sample bags produced by the apparatus of FIG. 4.
Figure 4A:
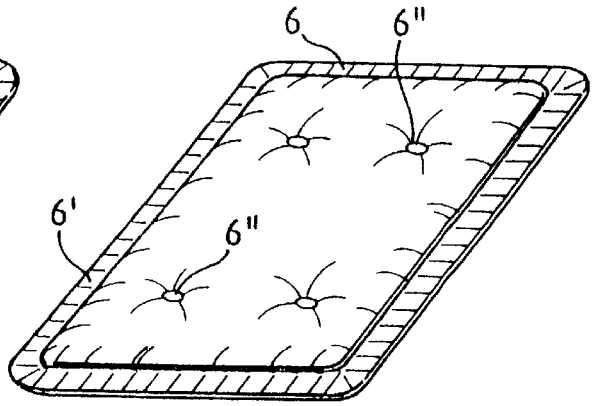

FIGS. 4, 4*a* and 4*b* schematically show a further embodiment of an apparatus for making a sample bag and the bags made thereby. In this embodiment, which is especially suitable for fluid sample products, the stabilization of form is achieved by producing joined locations in the chamber of the bag which contains the product in which joined locations of two webs 1' of film material are joined together in a way similar to the areas of the seams.

Experiments with bags having creamy contents show that by forming a system of chambers Joined lines) which do not impede the emptying of the bag but support it, similarly satisfying results can be achieved for the further processing of the bags. Depending on the dimensions of the bag, several chambers are imprinted which all discharge into a main chamber which again discharges into the outlet or the bag. Another tried method for stabilizing is to at least impede shifting of the contents when handled by producing point-like joined locations. After such measures, the contents can no longer collect in one area and thus no longer form irregular cushion forms.

The joined locations are produced by means of either cycled pressing or by roll pressing. The joined locations, point-like or linear in form, do not need the same stability as the seams around the periphery of the sample bag or of the sample product, respectively. Sample bags produced thus are "flat" in any position. As small leaks between the individual chambers do not influence the desired properties of the bag, the subsequent handling is not critical. A mere point fixing with only a few joined points to form upholstery-like recesses prevents the bag from assuming a cushion form.

The joining is, e.g., carried out on the finished sample bag wherein heat cannot be applied in all cases. Filling a sample bag with a fluid sample product may also be carried out by means of a reversible hollow needle after producing the joined points.

FIG. 4 shows an installation for producing the above described bag with fluid contents and stabilized by joined locations. Importance is attached to showing that stabilizing is again realized by means of pressing elements 5', which elements are very similar for fluid as well as for solid bag contents (pressing elements 5 in FIG. 2). The pressing elements for forming joined locations (when contents are fluid) are, depending on the method used for joining the inner surfaces of the bags, equipped for additionally applying, e.g., heat or ultrasonic. Such a solution is very suitable when known filling machines are used. For this reason and particularly for FIGS. 2 and 4 (or 3 and 5, respectively) regarding bag production in a cycled operation (or in a continuous operation, respectively) are very similar. The pressing element 5 or 5' is varied according to the measure of stabilizing: once it is a cushion for pressing out superfluous gas, then again it is a forming mold for forming joined locations.

The filling-in of a fluid sample product P takes place in the installation according to FIG. 4 in the direction of gravity g. Obviously, other filing methods which are not dependant on position, e.g., injecting through hollow needles, may also be used.

FIGS. 4*a* and 4*b* show sample bags producible in an installation according to FIG. 4, which bags are stabilized by joined locations between the two film blanks. The sample bag according to FIG. 4*a* comprises four joined points 6" which give the bag a more or less flat form by the fact that they define the distance between the webs of film material forming the chamber to be filled. FIG. 4*b* shows a bag with fluid contents which are distributed into two parallel chambers by joined lines 6" which chambers open into a common area. The joined lines 6" run parallel to sealing seam 6.

Sample bags according to FIG. 4*b*, in which the joined lines 6" run parallel to the longitudinal seams 6', can be produced with pressing elements as shown in FIGS. 2 and 3, which pressing elements are to be adapted regarding shape and function.

FIG. 5 shows an installation part 10 for continuous conditioning of sample bags with fluid contents by equipping them with joined locations. Sealing elements for the longitudinal sealing seams and sealing elements 4 for the transverse sealing seams as well as pressing elements 5 for the stabilizing or the forming of chambers in the bags, respectively, are integrated into two cylinders or form molds, respectively, between which the chamber for the sample product is formed by means of longitudinal seams. Pressing elements 5 are formed such that either joined lines 6" (FIG. 4*b*) or joined points 6" (FIG. 4*a*) are formed. Pressing elements 5 for conditioning consist of chambers K into which the bag to be conditioned can expand and of means M with which the joined locations are formed. By an opposed direction of rotation of the cylinders according to arrows Z, the partially enveloped sample product is conveyed in the direction of arrow z, simultaneously sealed longitudinally, conditioned and then sealed completely with a transverse seam. The transverse fins 4 serve this purpose. Here again, it is not defined whether the seams and the joined locations are formed by forming ribs or by welding or in a different manner. The filling with a fluid sample product P is, e.g., carried out in the direction of gravity g, as is also shown in FIG. 3. Here the fluid sample product can also be injected with hollow needles simultaneously with the forming of the joined locations.

Figure 6:
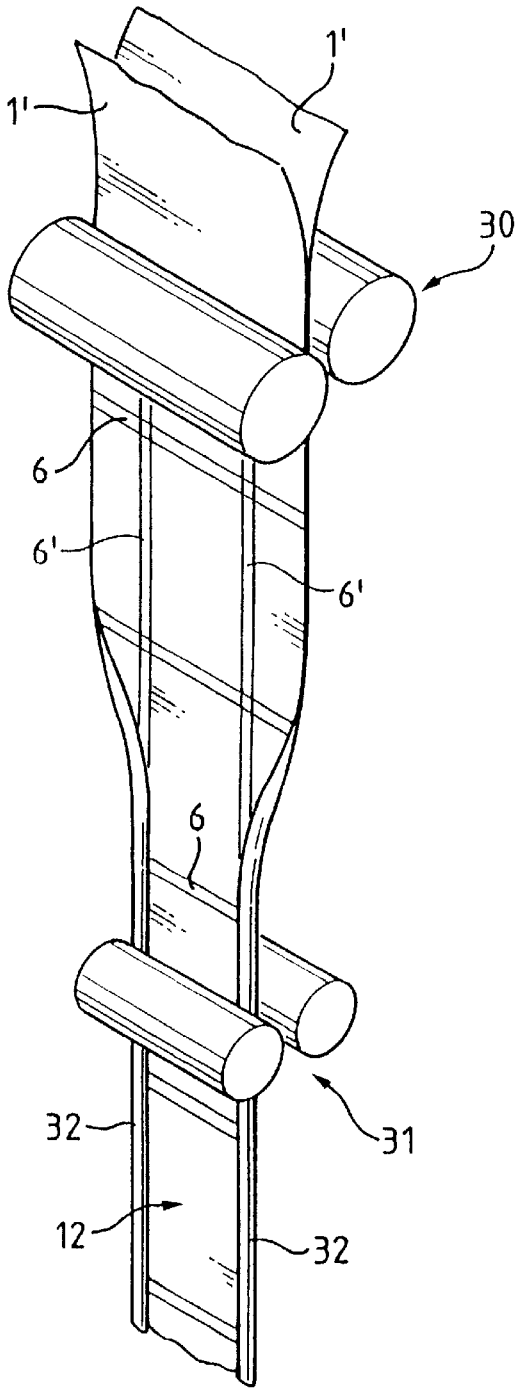
FIG. 6 is a schematic perspective view of an apparatus and method of making sample bags in accordance with the invention.
Figure 6A:
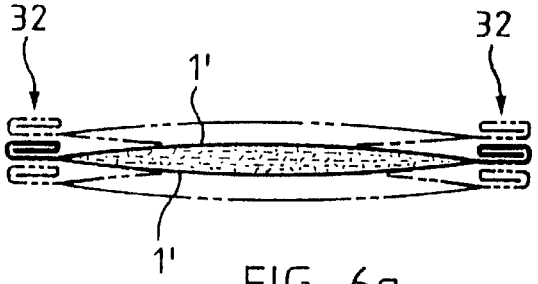
FIG. 6*a* is a schematic end elevation, in section, of a sample bag produced by the apparatus of FIG. 6.

FIGS. 6 and 6a show a further embodiment of the method according to the invention and the resulting product. In this embodiment, the sample bags are, after sealing but still as a quasi-endless web of bags, further formed by rolling or folding-in and pressing the longitudinal edges. FIG. 6 shows a part of the installation very schematically, which installation part comprises a pair of cylinders 30 (e.g., in analogy to the pairs of cylinders of FIGS. 3 and 5 but without pressing elements 5 or 5') for forming longitudinal seams 6' and transverse seams 6. In this case, the longitudinal seams 6' are not positioned at the very edges of the film material but at a distance from these, or they have a suitably greater width. Immediately after the forming of the web of bags, the longitudinal edges of the web are rolled or folded in by suitable guiding elements (not shown) and then pressed in this position, e.g., by a further pair of cylinders 31, possibly welded and thus stabilized in this position. The rolled or folded-in longitudinal edges 32 of the web of bags can also be stabilized by other means, e.g., by applying an adhesive before rolling in and by pressing afterwards.

FIG. 6*a* shows a sample bag produced in the installation according to FIG. 6 in section parallel to the transverse seams 6. The figure further shows with broken lines identical sample bags arranged in a stack. This stack shows that the areas of the longitudinal edges 32 formed by rolling or folding-in and stabilized by pressing, welding and/or gluing have the function of fins by which form of the bag, which is still substantially in the form of a cushion, no longer prevents the bags from being stackable in a stable manner furthermore the edge areas 32 stabilize the form of the bag through their increased stiffness.

Figure 7:
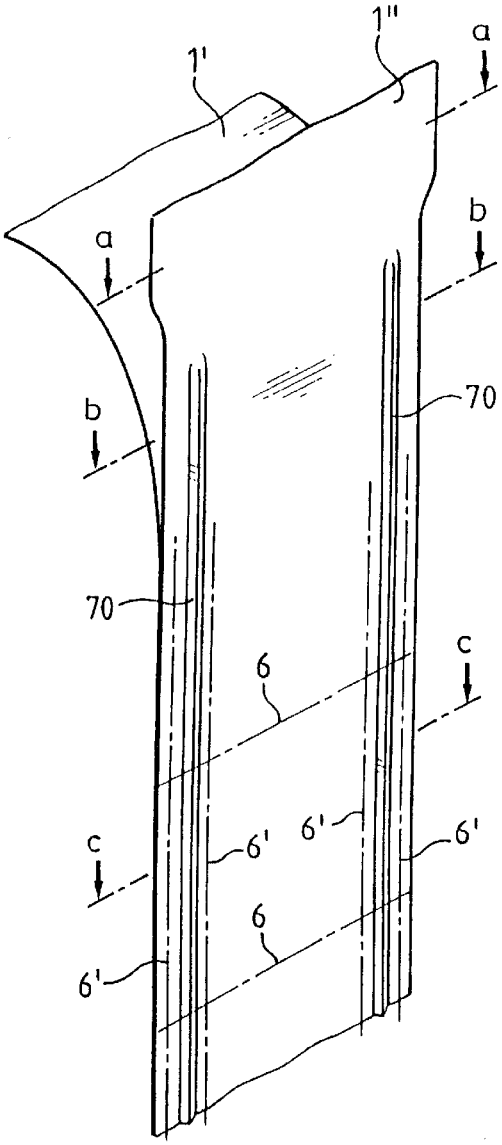
FIG. 7 is a schematic perspective view of a method and apparatus in accordance with the invention for making sample bags with a stabilization of edges thereof.
Figure 7A:
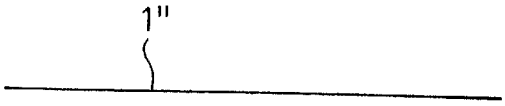
FIGS. 7*a*, 7*b* and 7*c* are schematic end elevations, in section, of sample bags produced in accordance with the method and apparatus of FIG. 7.
Figure 7B:
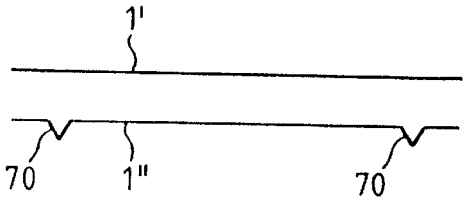

FIGS. 7 and 7*a* to 7*c* show a further embodiment of the method according to the invention which again comprises an additional forming step. In this method step, a fold 70 in the form of a ridge is formed with suitable forming tools (not shown) on each side of one (1") of the webs of film material (FIG. 7*a*). Thus, before sealing the longitudinal seams 6', for each ridge, three folding lines with alternating folding directions are formed parallel with the longitudinal edges of the web of film material. The web 1" with folds 70 is then further conveyed such that by suitable reduction of its width, the folds are given the desired height (FIG. 7*b*). Thus guided, the web 1" is brought together with the other web 1' and longitudinal seams are formed as double seams on both sides of folds 70 (shown with two broken lines on each side of the fold lines).

Figure 7C:
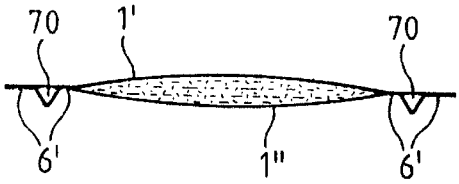

A section parallel to the transverse seams of a finished sample bag is shown in FIG. 7*c*. It is apparent that the folds 70 filed by the double longitudinal seams 6' have the same function as the thickened edge areas of the bags according to FIG. 6*a*. A possibly significant difference to the embodiment of FIG. 6*a* is that folds 70, after manipulation which they facilitate or make possible, may be flattened easily and then only increase the thickness of the bag to a very small degree. In other words, sample bags according to FIG. 7*c* can safely and without problems, e.g., be inserted into printed products at high processing speeds thanks to the stabilizing effect of folds 70. Just as easily, folds 70 can be flattened when the bag is being attached on or in a printed product or later by means of pressing, so that the bag then only minimally increases the thickness of the printed product.

Variations on the method of FIGS. 7 and 7*a* to 7*c* can comprise forming one or two folds on each of the two webs of film material and the folds need not have the forms of ridges (not have a triangular cross-section) but rather have a cross-section in the form of the segment of a circle or a trapezoid. The original width of the two webs of film can be identical or adapted to each other such that the longitudinal edges of the two webs match in the finished bag.

FIGS. 8 and 8*a* show a further embodiment of the inventive method and the corresponding product. The sample bags produced according to this embodiment are stabilized by an additional forming element. In this case, the additional forming elements are frames 33 which are positioned between the webs of film material 1' and 1" as a quasi-endless web of frames 33', which frames are filed to the webs of film material when the longitudinal and transverse seams are made and are separated from each other together with the bags. The frames 33, e.g., comprise plastic (solid or foamed) and have a thickness of, e.g., 0.5 to 1 mm.

For the sample bags to be openable easily in spite of the frames, it is suggested to make one web of film material 1" slightly wider than the other web 1' of film material so that the film material is not flush with the frame (area 34). Furthermore, it is suggested that the materials of at least one web 1" and of the frame be chosen so that they form a peelable connection. FIG. 7*a* shows a sample bag with a frame 33 in section parallel to the transverse seams. That figure also shows the peelable area of the film in a closed and in an open (34') position.

FIGS. 9*a* and 9*b* shows a further embodiment of the inventive method and the corresponding product. The method is based on two webs 1' of film material and a web 33' of frames wherein the web of frames is not positioned between the webs of film material as in the method of FIG. 8 but is adjacent to the webs of film material.

For the sample bags according to FIGS. 9*a* and 9*b* t be easily openable, frames 33 comprise, e.g., gaps 35 in one comer. The webs 1' are, e.g., equipped with perforations in the corresponding locations. Instead of the shown gaps 35 and corresponding perforations, in analogy to the method of FIG. 8, the web 1' facing away from the web of frames 33' can be chosen to be somewhat wider and to be connected to the other web of material with a peelable connection. Such a sample bag is then openable in the same way as that of FIG. 8*a*.

FIGS. 10*a* and 10*b* shows a further embodiment of the method and the corresponding product. As additional forming elements, two strips 40 are introduced into the method before or after the forming of the longitudinal and transverse seams, which strips are connected to one of the webs 1' of film material or with the web of sample bags in the area of the longitudinal seams, e.g., by welding or gluing. A direct extrusion of a suitable plastic onto one of the webs of film material or onto the web of sample bags is also possible. The strips can, in analogy to the method described in connection with FIGS. 8 and 8*a*, also be introduced between the two webs of film material 1' before the forming of the seams.

Strips 40 can be adapted in a wide spectrum to the webs of film material used, to the contents of the sample bags, and/or to the production parameters in regard to the material selection and the texture of the material and as to cross-section. They are strips made of cardboard, paper or plastic (solid or foamed) with any hollow or solid cross-section. While the specific shape is not important, it will be recognized that the material should be sufficiently incompressible to remain substantially undeformable under the rather small forces encountered in the circumstances described herein.

FIGS. 11*a*, 11*b* and 12*a*, 12*b* show variations on the inventive method and products in which the stabilizing of form is achieved by at least one individual forming element for every single sample bag. These forming elements are, e.g., rings 41 introduced between the webs of film material 1' and 1" or supporting circles or points 42 attached to one outer surface of the bag in the area of the comer of the bag. The forming elements are, e.g., attached before the forming of the longitudinal and transverse seams by welding, gluing or similar connecting methods.

The rings when used as forming elements can comprise, as described for the frames (FIGS. 9*a* and 9*b*), e.g., gaps 43 for opening the sample bags.

What is claimed is:

1. A sample bag comprising first and second generally rectangular blanks of bag material of substantially the same size, each said blank having longitudinal side edges and transverse side edges, said blanks being juxtaposed with an inner surface of said first blank facing an inner surface of said second blank, said inner surfaces of longitudinal side edges of said first blank being sealed to inner surfaces of said longitudinal side edges of said second blank and inner surfaces of said transverse side edges of said first blank being sealed to inner surfaces of said transverse side edges of said second blank, thereby forming a rectangular bag with a sealed central compartment surrounded by longitudinal and transverse seam areas, a predetermined quantity of deformable or flowable material enclosed in said sealed central compartment of said bag giving said central compartment a variable form with a local maximum thickness; and means in said longitudinal seam areas for increasing said longitudinal seam areas to a thickness substantially equal to said local maximum thickness of said central portion whereby stackability of the bag and handling in high-speed automatic machines is improved.

2. A sample bag according to claim 1 wherein said longitudinal seam areas are rolled to form said means for increasing.

3. A sample bag according to claim 1 wherein said longitudinal seam areas are folded to form said means for increasing.

4. A sample bag according to claim 1 wherein said longitudinal seam areas comprise a thickness forming element attached to said longitudinal side edges.

5. A sample bag according to claim 4 wherein said thickness forming element comprises a frame.

6. A sample bag according to claim 5 wherein said thickness forming element is positioned between said edges of said first and second blanks.

7. A sample bag according to claim 4 wherein said thickness forming element comprises strips of thickening material.

8. A sample bag according to claim 5 wherein said thickness forming elements are positioned between adjacent longitudinal edges of said first and second blanks.

9. A sample bag according to claim 1 wherein said side edges are folded to form ridges having said thickness.

10. A sample bag comprising first and second generally rectangular blanks of bag material of substantially the same size, each said blank having longitudinal side edges and transverse side edges, said blanks being juxtaposed with an inner surface of said first blank facing an inner surface of said second blank, said inner surfaces of longitudinal side edges of said first blank being sealed to said inner surfaces of longitudinal side edges of said second blank and said inner surfaces of said transverse side edges of said first blank being sealed to said inner surfaces of said transverse side edges of said second blank, thereby forming a rectangular bag with a sealed central compartment surrounded by longitudinal and transverse seam areas, a predetermined quantity of deformable or flowable product material enclosed in said central compartment so that said compartment has a local maximum thickness; and means in said seam areas of said bag having a substantially undeformable thickness for increasing the thickness of said seam areas to be substantially equal to said thickness of said central portion, and thereby improving the stacking and handling characteristics of said bag.

11. A sample bag according to claim 10 wherein said means on said bag comprises a plurality of elements attached to an outer surface of one of said blanks.

12. A sample bag according to claim 10 wherein said means on said bag comprises an annular element contained in said bag.

* * * * *